US006568048B2

(12) United States Patent
Liu

(10) Patent No.: US 6,568,048 B2
(45) Date of Patent: May 27, 2003

(54) SHOE WITH A SHOE LACE DEVICE THAT CAN BE TIGHTENED TO SIMULATE A DOUBLE-BOW KNOT

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,858

(22) Filed: Aug. 3, 2001

(65) Prior Publication Data

US 2003/0024087 A1 Feb. 6, 2003

(51) Int. Cl.[7] ..... A43C 7/00
(52) U.S. Cl. ..... 24/712.2; 24/712.5; 24/115 G
(58) Field of Search ..... 24/712–712.9, 24/115 G; 36/50.1

(56) References Cited

U.S. PATENT DOCUMENTS 743,924 A * 11/1903 Pratt
2,893,090 A * 7/1959 Pagoda
3,065,512 A * 11/1962 Pagoda
3,701,572 A * 10/1972 Velasquez
4,342,557 A * 8/1982 Bandar
5,065,482 A * 11/1991 Lofy
6,178,606 B1 * 1/2001 Glendon

FOREIGN PATENT DOCUMENTS

WO WO 98/47401 * 10/1998

* cited by examiner

*Primary Examiner*—James R. Brittain
(74) *Attorney, Agent, or Firm*—Foley & Lardner

(57) ABSTRACT

A shoe includes a shoe body and a shoe lace device. The shoe body has a pair of eyelet tabs. The shoe lace device includes first, second, third, and fourth lace sections, a clamp member, and a decorative knot. Lower ends of the first to fourth lace sections are anchored on the shoe body. The upper ends of the first and second lace sections, and those of the third and fourth lace sections, are interconnected to form first and second loops, respectively. The clamp member is sleeved slidably on medial portions of the lace sections. The decorative knot is secured on and is disposed externally of the clamp member, is disposed between the first and second loops, and has a knot and two distal portions. Downward and upward movements of the clamp member along the lace sections permit the tightening and loosening of the shoe body.

5 Claims, 11 Drawing Sheets

SHOE WITH A SHOE LACE DEVICE THAT CAN BE TIGHTENED TO SIMULATE A DOUBLE-BOW KNOT

BACKGROUND OF THE INVENTION

1. Field of the Invention

The invention relates to a shoe, more particularly to a shoe having a shoe lace device that can be tightened to simulate a double-bow knot.

2. Description of the Related Art

Referring to FIG. 1, a conventional shoe 4 comprises a shoe body 41 and a shoe lace device 1. The shoe body 41 has a pair of eyelet tabs 5. The shoe lace device 1 includes a shoe lace 2 having first and second lace sections 201, 202, and a clamp member 3. The first lace section 201 is strung on the shoe body 41 so as to form a criss-cross pattern on the eyelet tabs 5. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe 4 has a shoe lace device 1 that is easy to use, the simple loop configuration of the second lace section 202 has an unattractive appearance.

SUMMARY OF THE INVENTION

Therefore, the main object of the present invention is to provide a shoe having a shoe lace device that can be tightened to simulate a double-bow knot.

Accordingly, a shoe of this invention comprises a shoe body and a shoe lace device. The shoe body has a pair of eyelet tabs. The shoe lace device includes: first, second, third, and fourth lace sections, each of which has a lower end and an upper end; a clamp member; and a decorative knot. The lower ends of the first to fourth lace sections are anchored on the shoe body. The upper ends of the first and second lace sections are interconnected to form a first loop. The upper ends of the third and fourth lace sections are interconnected to form a second loop. The clamp member is sleeved slidably on medial portions of the first to fourth lace sections. Downward movement of the clamp member along the first to fourth lace sections brings the lower ends of the first to fourth lace sections closer together for tightening the shoe body. Upward movement of the clamp member along the first to fourth lace sections permits the lower ends of the first to fourth lace sections to move away from each for loosening the shoe body. A decorative knot is secured on and is disposed externally of the clamp member, is disposed between the first and second loops, and has a knot portion and a pair of distal portions extending from the knot portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
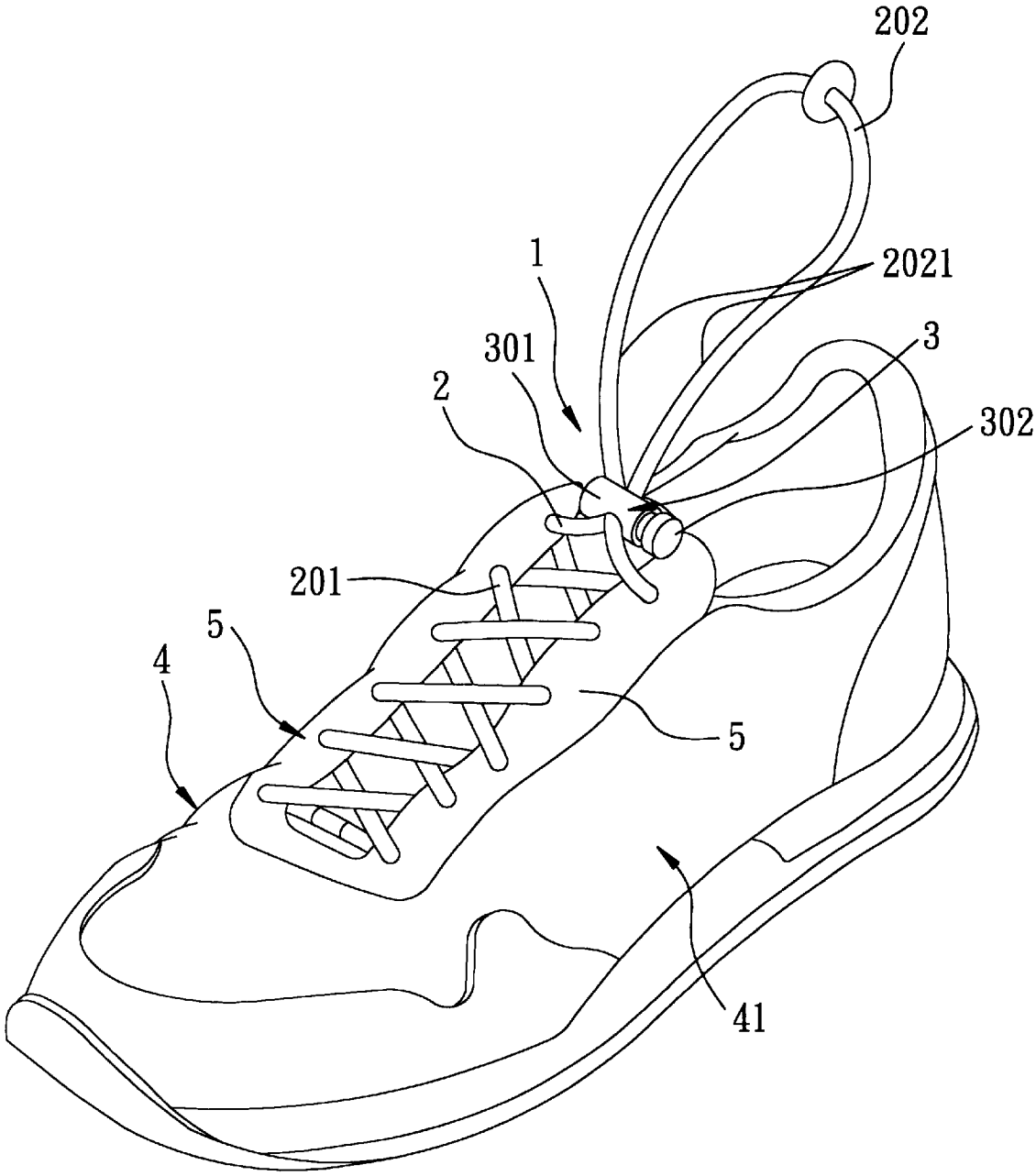
FIG. 1 PRIOR ART
FIG. 1 is a perspective view of a conventional shoe.
Figure 2:
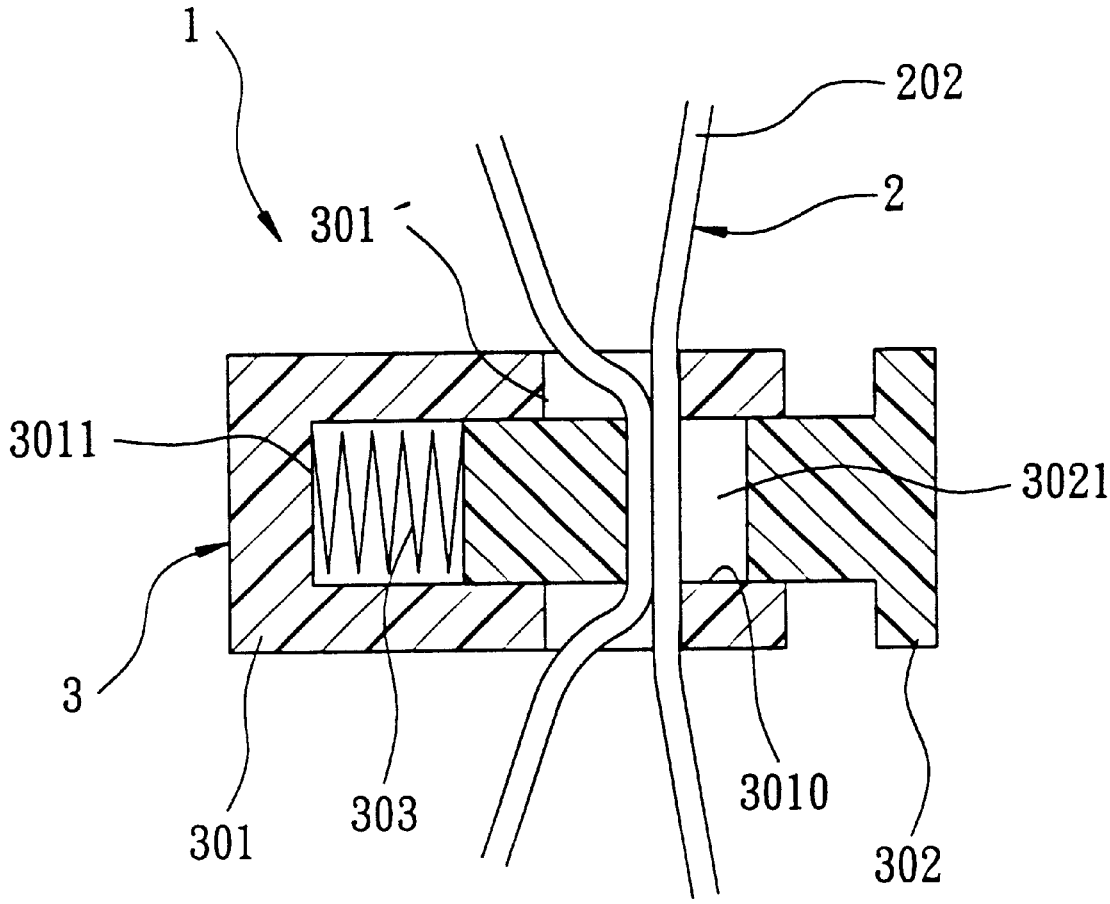
FIG. 2 PRIOR ART
FIG. 2 is a cross-sectional view of a clamp member of a shoe lace device of the conventional shoe.

Before the present invention is described in greater detail, it should be noted that like elements are denoted by the same reference numerals throughout the disclosure.

Figure 3:
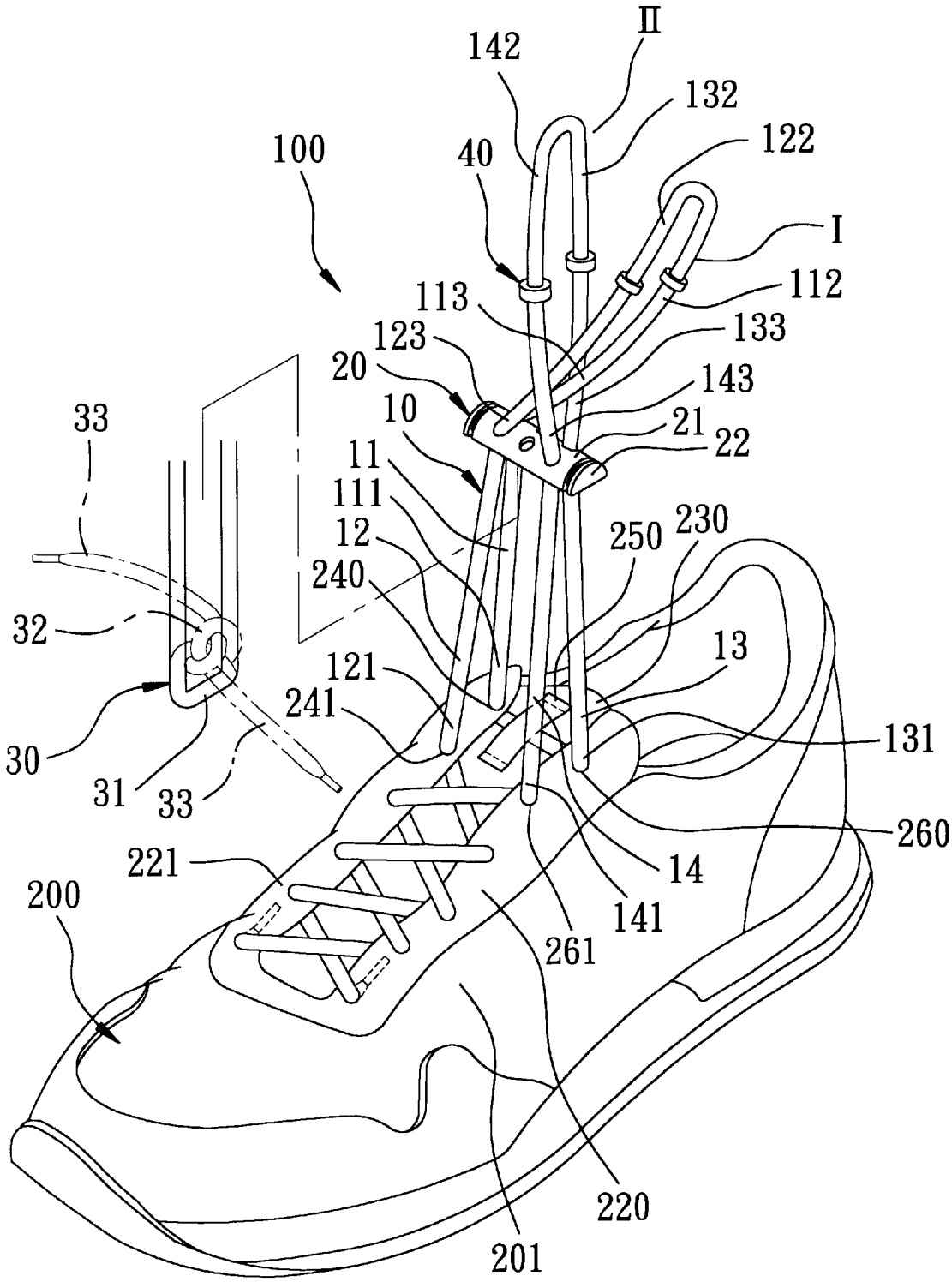
FIG. 3 is a perspective view of the first preferred embodiment of a shoe according to the present invention.

Referring to FIG. 3, the first preferred embodiment of a shoe 200 according to the present invention is shown to comprise a shoe body 201 and a shoe lace device 100. The shoe body 201 has a pair of eyelet tabs 221, 220, and a tongue 230. A retainer 250 is sewn on the tongue 230. The shoe lace device 100 includes a shoe lace 10, a clamp member 20, and a decorative knot 30. The shoe lace 10 has a first lace segment that is strung on the shoe body 201 in a conventional manner so as to form a criss-cross pattern on the eyelet tabs 221, 220; and a second lace segment that includes first, second, third, and fourth lace sections 11, 12, 13, 14, each of which has a lower end and an upper end. The first lace segment has distal ends concealed by the eyelet tabs 221, 220. The lower ends 111, 121, 131, 141 of the first to fourth lace sections 11, 12, 13, 14 are anchored on the shoe body 201 in a manner to be described hereinafter. The upper ends 112, 122 of the first and second lace sections 11, 12 are interconnected to form a first loop (I). The upper ends 132, 142 of the third and fourth lace sections 13, 14 are interconnected to form a second loop (II). One of the first and second loops (I), (II) extends through the other of the first and second loops (I), (II). Furthermore, stop rings 40 are sleeved fittingly on the upper ends 112, 122, 132, 142 of the first to fourth lace sections 11, 12, 13, 14, respectively.

Figure 4:
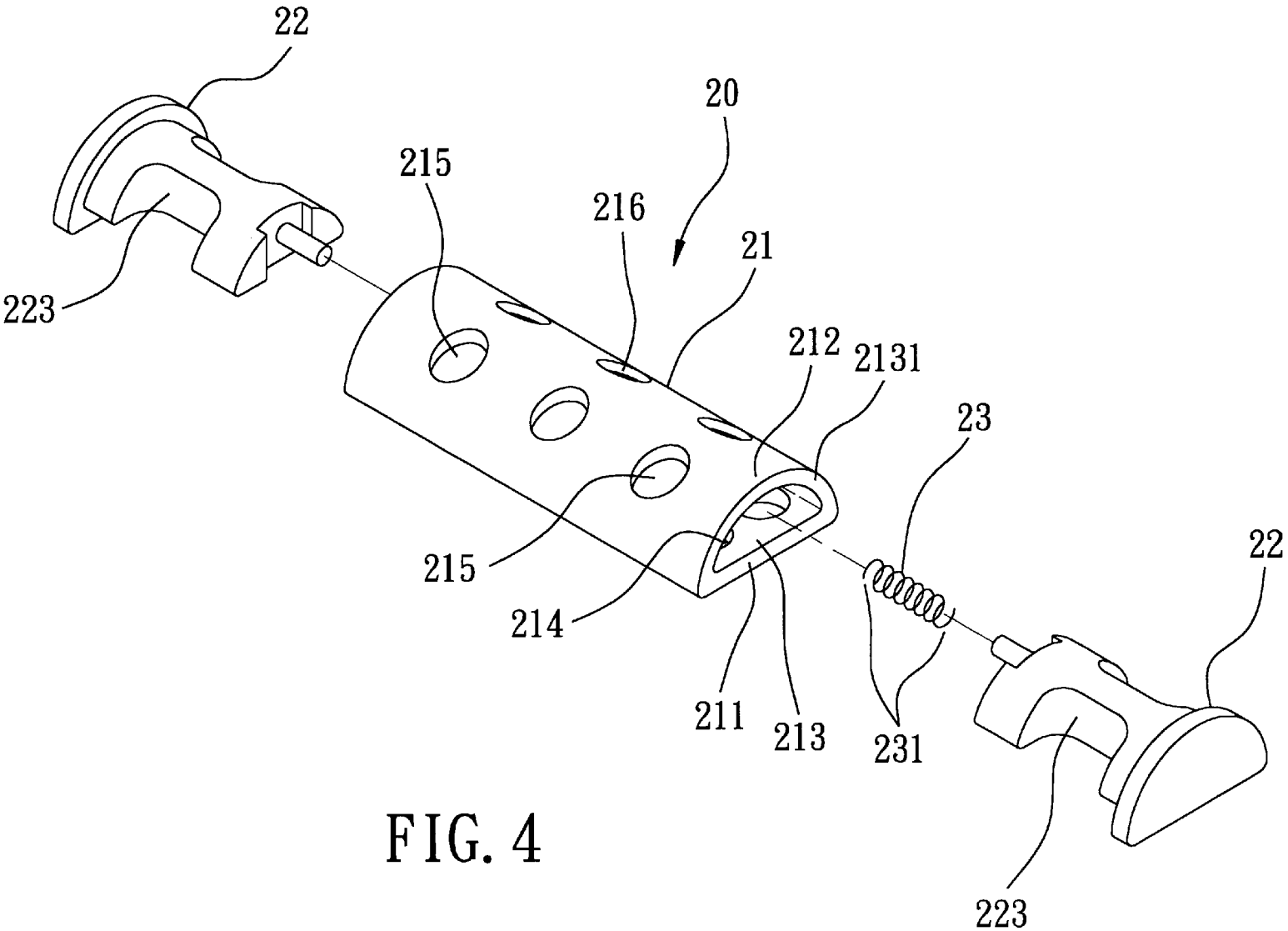
FIG. 4 is an exploded perspective view of a clamp member of a shoe lace device of the shoe according to the present invention.
Figure 6:
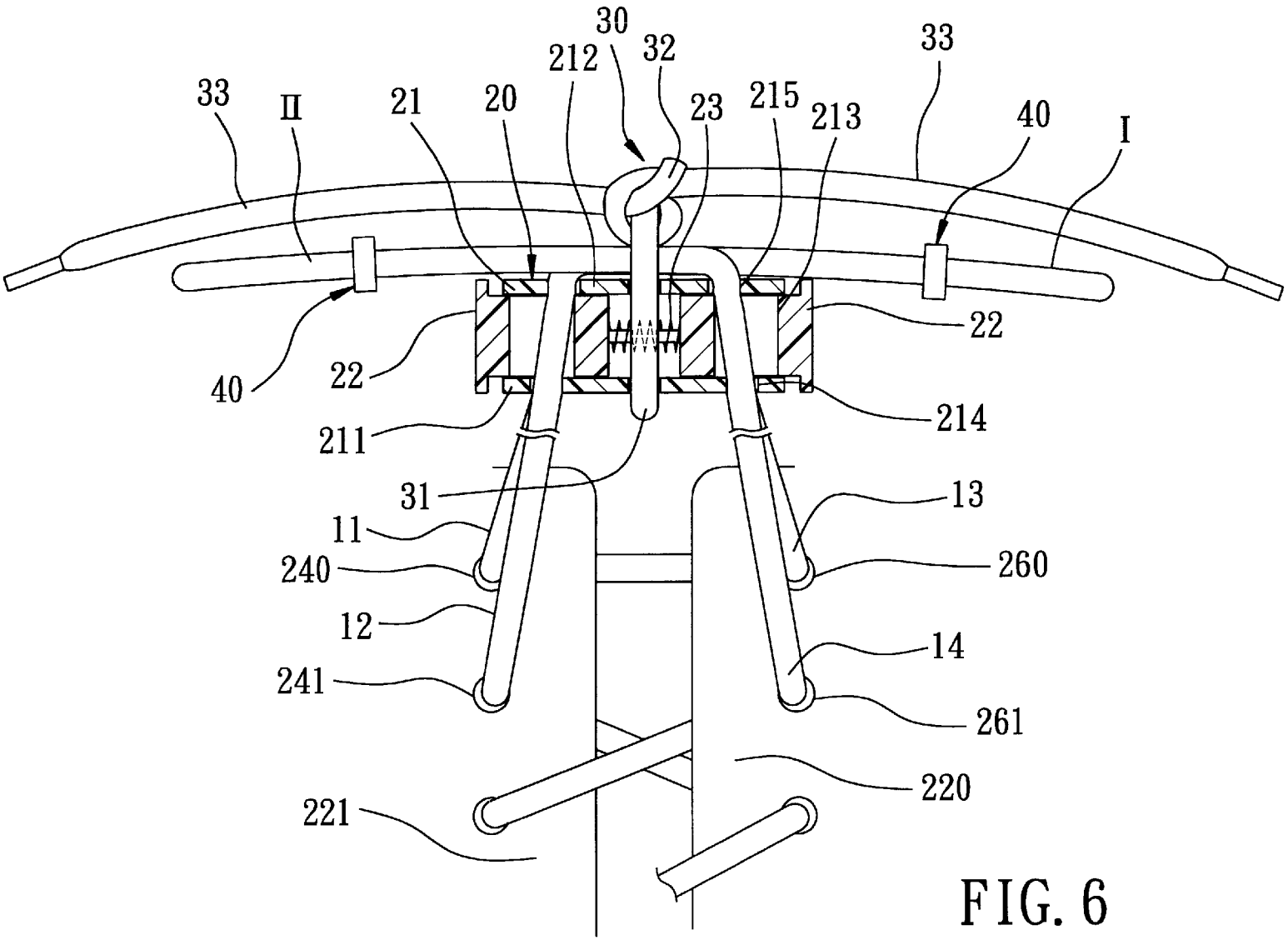
FIG. 6 is a cross sectional view illustrating how the lower ends of the lace sections are clamped by the clamp member to tighten the shoe.
Figure 7:
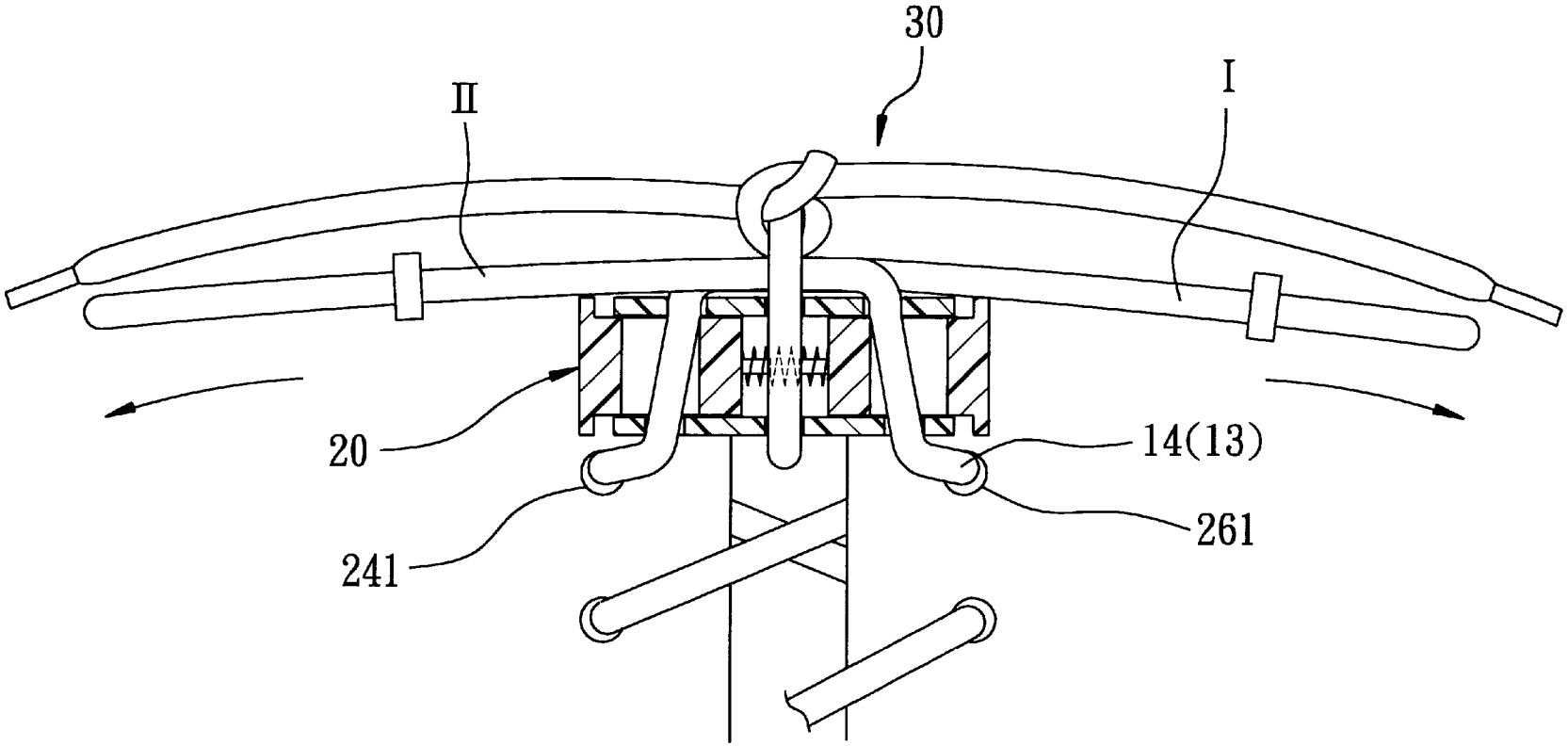
FIG. 7 is a cross sectional view showing how the shoe body is tightened upon pulling apart a pair of loops.

The clamp member 20 is sleeved slidably on medial portions 113, 123, 133, 143 of the first to fourth lace sections 11, 12, 13, 14. As shown in FIG. 4, the clamp member 20 includes an elongate casing 21, a pair of clamping blocks 22, and a biasing member 23. The elongate casing 21 has opposite lateral open end portions 213 that are spaced apart from each other in a first direction. Each of the open end portions 213 of the casing 21 has an end face 2131, and is formed with a pair of vertically extending hole units 214, 215 that are arranged in a second direction transverse to the first direction and that permit extension of the medial portions 113, 123, 133, 143 of a respective set of the first and second lace sections 11, 12, and third and fourth lace sections 13, 14 therethrough. The casing 21 includes a lower base plate 211, and a curved upper cover plate 212 connected to the lower base plate 211. Each of the hole units 215, 214 includes an upper hole part 215 formed in the upper cover plate 212, and a lower hole part 214 formed in the lower base plate 211. The lower hole part 214 is disposed closer to the end face 2131 of the respective one of the open end portions 213 than the upper hole part 215, as best illustrated in FIGS. 6 and 7. Moreover, two vertically extending holes 216 are formed between the open end portions 213 of the casing 21.

The clamping blocks 22 are slidably and respectively received in the open end portions 213 of the casing 21, and are each formed with a pair of vertically extending slot units 223 that correspond respectively to the pair of the hole units 214, 215 in the respective one of the open end portions 213 of the casing 21 for extension of the medial portions 113, 123, 133, 143 of the respective pair of the first and second lace sections 11, 12, and third and fourth lace sections 13, 14.

Figure 5:
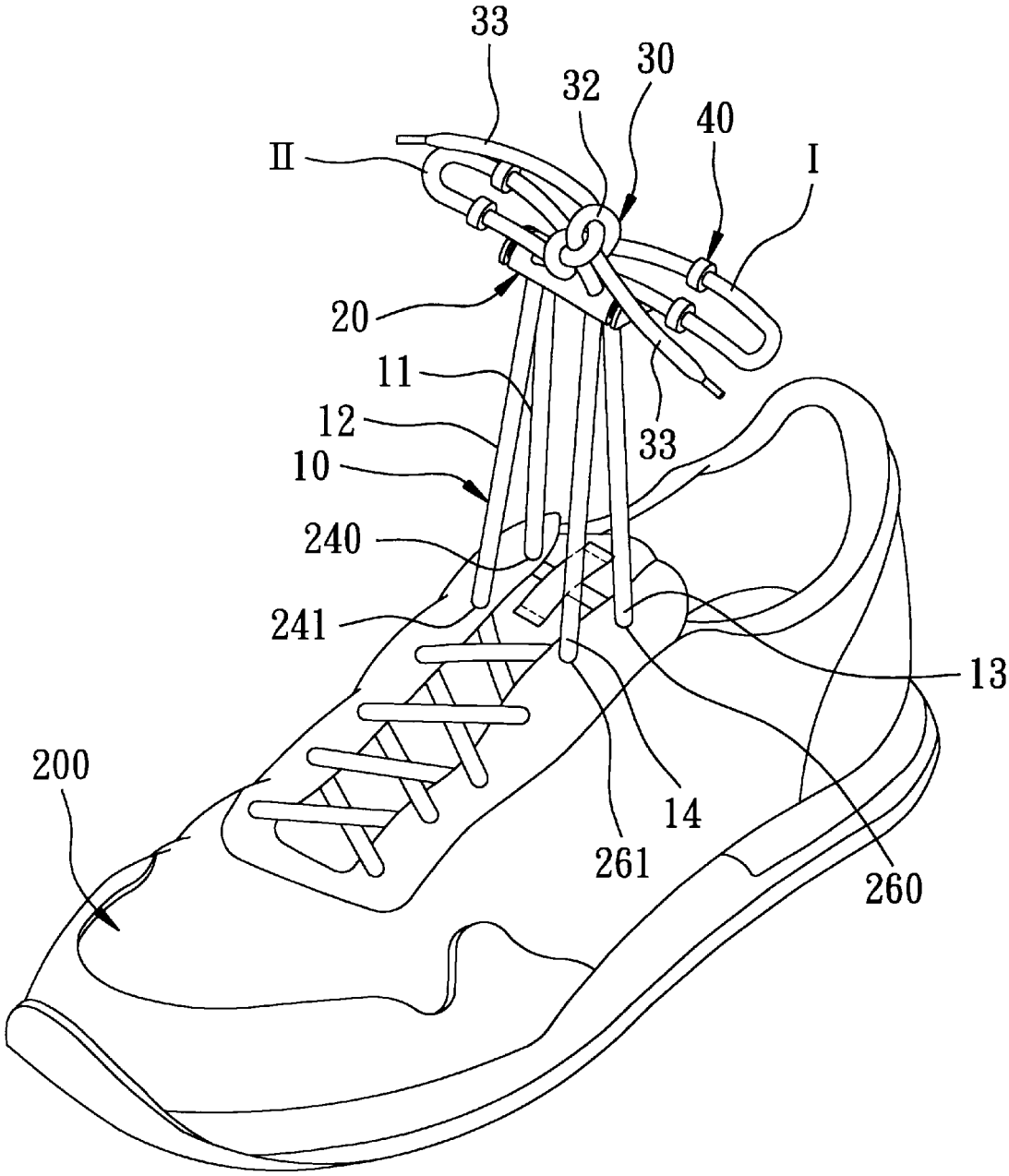
FIG. 5 is a perspective view illustrating how upward movement of the clamp member permits lower ends of lace sections to move away from each so as to loosen the shoe.
Figure 8:
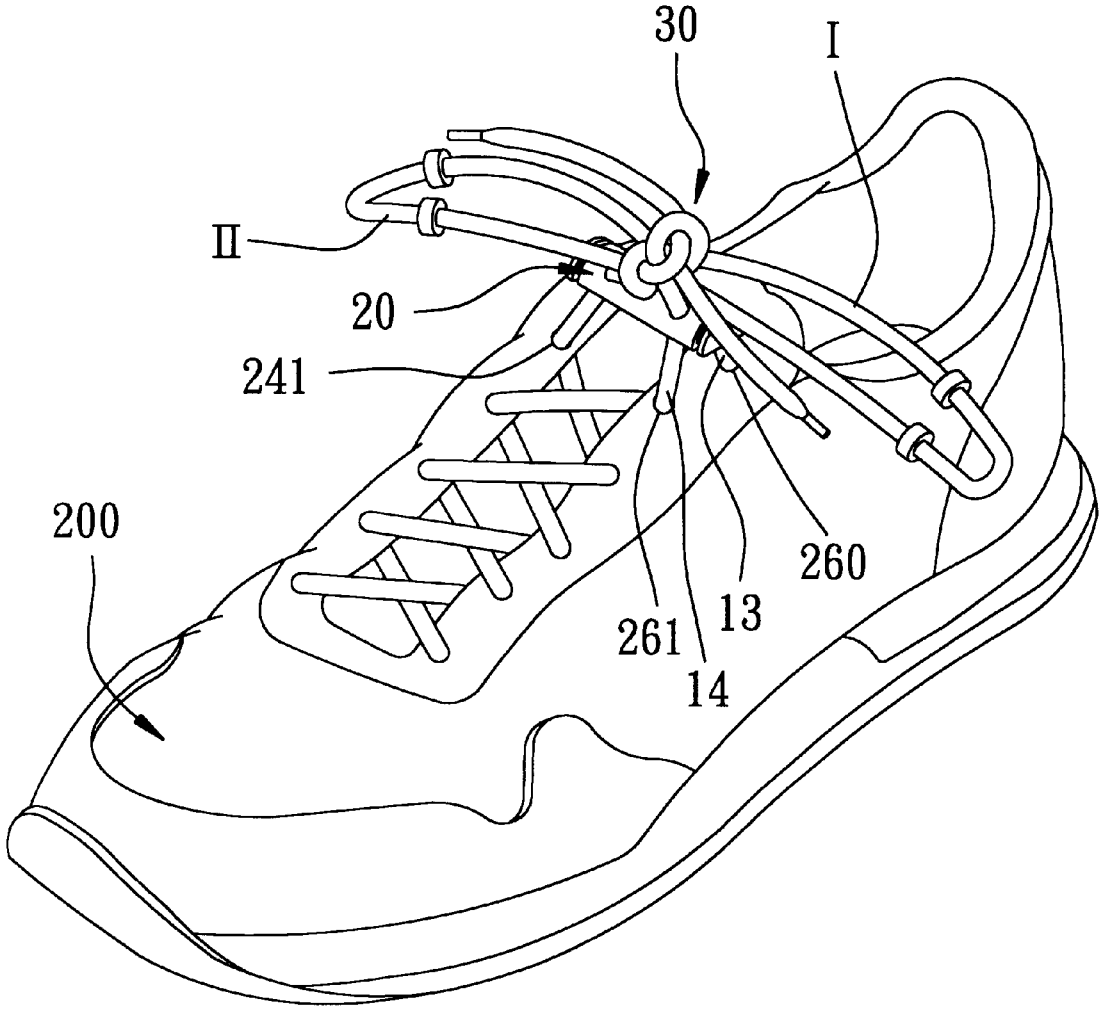
FIG. 8 is a perspective view showing the shoe of the first preferred embodiment.

The biasing member 23, in the form of a coil spring, is disposed in the casing 21 and has opposite ends 231 that abut respectively against the clamping blocks 22 for biasing the clamping blocks 22 outwardly of the open end portions 213 of the casing 21. As such, the clamping blocks 22 are biased by the biasing member 23 so as to misalign the slot units 223 from the hole units 214, 215, in order to clamp the medial portions 113, 123, 133, 143 of the first to fourth lace sections 11, 12, 13, 14 between the clamping blocks 22 and the casing 21. Downward movement of the clamp member 20 along the first to fourth lace sections 11, 12, 13, 14 brings the lower ends 111, 121, 131, 141 of the first to fourth lace sections 11, 12, 13, 14 closer together for tightening the shoe body 201, as shown in FIGS. 7 and 8. Upward movement of the clamp member 20 along the first to fourth lace sections 11, 12, 13, 14 permits the lower ends 111, 121, 131, 141 of the first to fourth lace sections 11, 12, 13, 14 to move away from each other for loosening the shoe body 201, as shown in FIG. 5.

The decorative knot 30 is secured on and is disposed externally of the clamp member 20, and is further disposed between the first and second loops (I), (II). The decorative knot 30 has a U-shaped retaining portion 31, a knot portion 32, and a pair of distal portions 33. The retaining portion 31 has segments that extend through the holes 216 in the casing 21 so as to secure the same to the casing 21. The knot portion 32 is connected to the retaining portion 31, and is disposed externally of the casing 21. Each of the distal portions 33 extends from the knot portion 32. The medial portions 113, 123, 133, 143 of the first to fourth lace sections 11, 12, 13, 14 further extend between the casing 21 and the knot portion 32.

In use, by pulling apart the first and second loops (I), (II), the clamp member 20 will be forced to slide downwardly along the lace sections 11, 12, 13, 14, and the lower ends 111, 121, 131, 141 of the latter will be brought closer together at the same time for tightening the shoe 200. To loosen the shoe 200, the clamping blocks 22 are operated to compress the biasing member 23, thereby aligning the slot units 223 with the hole units 214, 215. At this time, by moving the clamp member 20 upwardly along the lace sections 11, 12, 13, 14, the lower ends 111, 121, 131, 141 of the latter can move away from each for loosening the shoe 200.

Therefore, the shoe 200 is not only easy to wear and remove, but also has an attractive appearance in view of the double-bow configuration of the shoe lace device 100.

In the first preferred embodiment, the lower ends 121, 141 of the second and fourth lace sections 12, 14 are connected to the first lace segment at two of the eyelets 241, 261 in the eyelet tabs 221, 220. The lower end 111 of the first lace section 11 extends through an eyelet 240 of the left eyelet tab 221, passes through the retainer 250 on the tongue 230, and crosses to the right eyelet tab 220 to connect with the lower end 131 of the third lace section 13.

Figure 9:
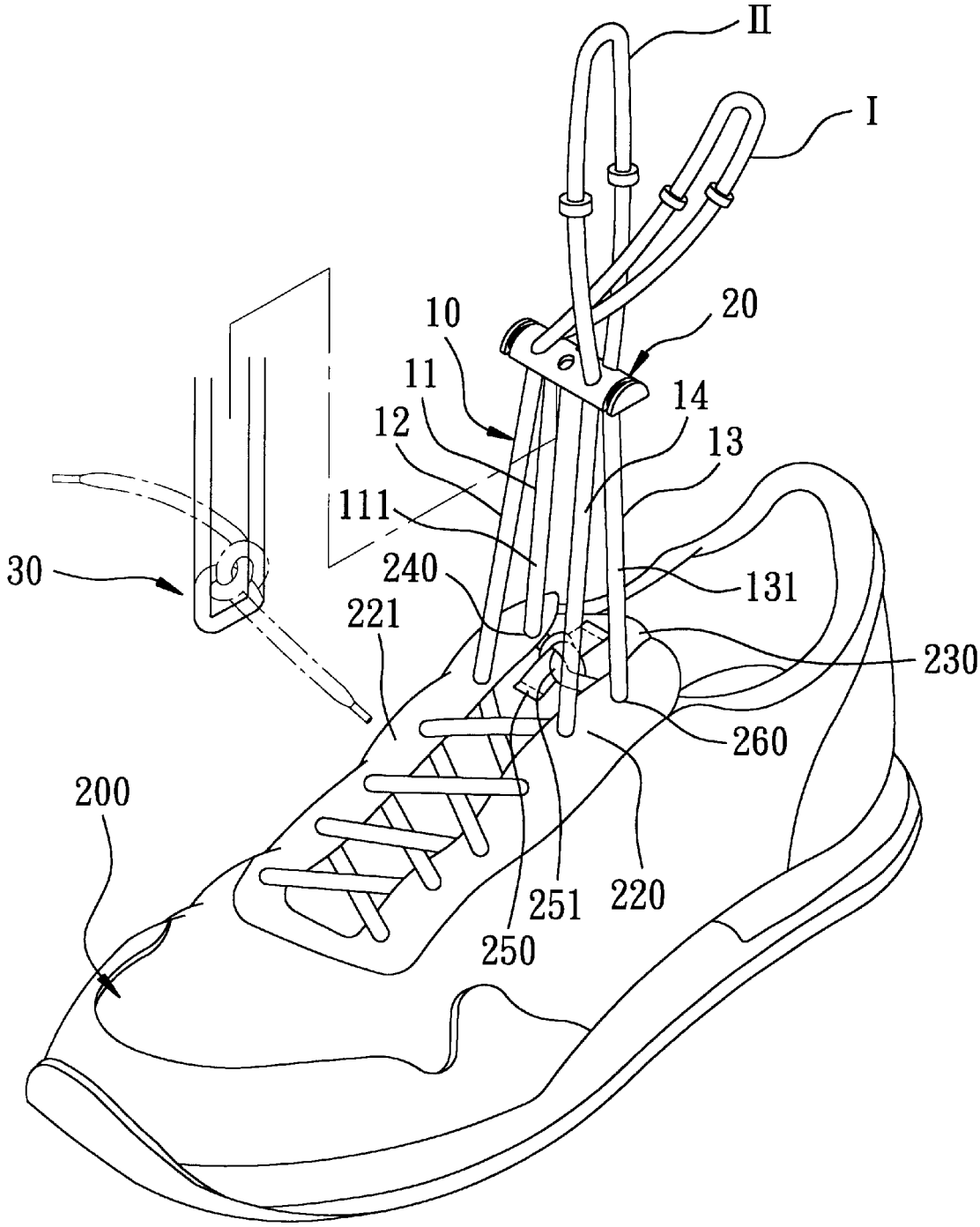
FIG. 9 is a perspective view illustrating the second preferred embodiment of a shoe according to the present invention.

FIG. 9 illustrates the second preferred embodiment of a shoe 200 according to the present invention. Unlike the first preferred embodiment, a positioning knot 251 having opposite ends is tied on the retainer 250 of the tongue 230 and interconnects the lower ends 111, 131 of the first and third lace sections 11, 13.

The shoe 200 of the second preferred embodiment operates in a manner substantially similar to that of the first preferred embodiment. In this embodiment, the shoe lace device 100 can be effectively tightened due to the presence of the positioning knot 251 on the retainer 250.

Figure 10:
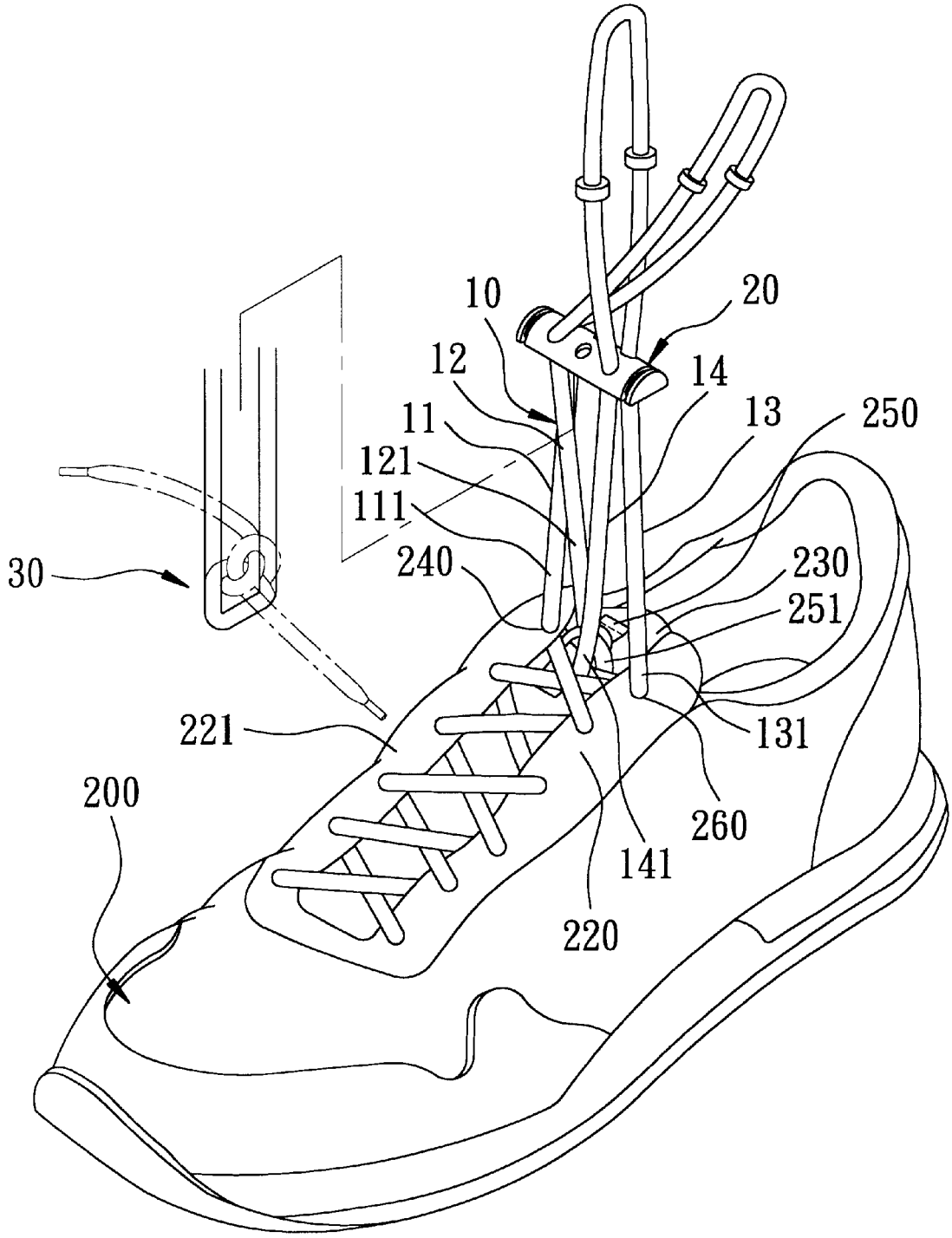
FIG. 10 is a perspective view illustrating the third preferred embodiment of a shoe according to the present invention.

As shown in FIG. 10, the third preferred embodiment of a shoe 200 according to the present invention is shown to be substantially similar to the first and second embodiments. However, unlike the first and second embodiments, the lower ends 111, 131 of the first and third lace sections 11, 13 are connected to the first lace segment. The lower ends 121, 141 of the second and fourth lace sections 12, 14 are anchored on the shoe via the positioning knot 251 on the retainer 250.

Figure 11:
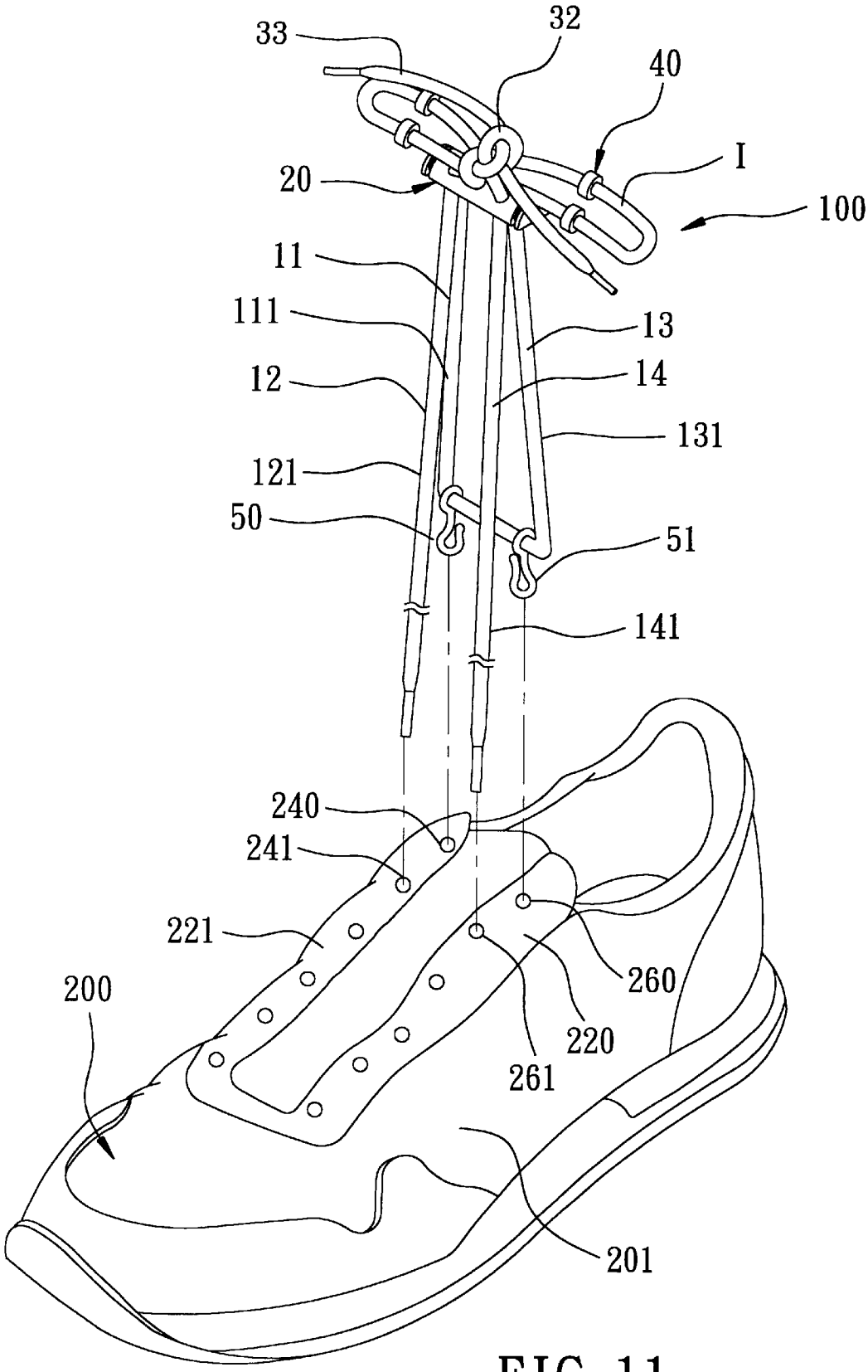
FIG. 11 is a partly exploded perspective view illustrating the fourth preferred embodiment of a shoe according to the present invention.

Referring to FIG. 11, the fourth preferred embodiment of a shoe 200 according to the present invention is shown to be substantially similar to the previous preferred embodiments. However, unlike the previous embodiments, the shoe lace device 100 further includes a pair of hook members 50, 51. The first hook member 50 is used to secure removably the lower end 111 of the first lace section 11 onto the eyelet tab 221 of the shoe body 201 at one of the eyelets 240. The second hook member 51 is used to secure removably the lower end 131 of the third lace section 13 onto the eyelet tab 220 of the shoe body 201 at one of the eyelets 260.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe comprising:

a shoe body having a pair of eyelet tabs; and a shoe lace device including first, second, third and fourth lace sections, each of which has a lower end and an upper end, said lower ends of said first to fourth lace sections being anchored on said shoe body, said upper ends of said first and second lace sections being interconnected to form a first loop, said upper ends of said third and fourth lace sections being interconnected to form a second loop, a clamp member sleeved slidably on medial portions of said first to fourth lace sections, downward movement of said clamp member along said first to fourth lace sections bringing said lower ends of said first to fourth lace sections closer together for tightening said shoe body, upward movement of said clamp member along said first to fourth lace sections permitting said lower ends of said first to fourth lace sections to move away from each for loosening said shoe body, and a decorative knot secured on and disposed externally of said clamp member, said decorative knot being disposed between said first and second loops, and having a knot portion and a pair of distal portions extending from said knot portion, wherein said clamp member includes:

an elongate casing with opposite lateral open end portions that are spaced apart from each other in a first direction, each of said open end portions being formed with a pair of vertically extending hole units that are arranged in a second direction transverse to the first direction and that permit extension of said medial portions of a respective pair of said first and second lace sections and said third and fourth lace sections therethrough;

a pair of clamping blocks slidably and respectively received in said open end portions of said casing, each of said clamping blocks being formed with a pair of vertically extending slot units that correspond respectively to said pair of said hole units in the respective one of said open end portions of said casing for extension of said medial portions of the respective pair of said first and second lace sections and said third and fourth lace sections; and a biasing member disposed in said casing and having opposite ends that abut respectively against said clamping blocks for biasing said clamping blocks outwardly of said open end portions of said casing, thereby clamping said medial portions of said first to fourth lace sections between said clamping blocks and said casing.

2. The shoe of claim 1, wherein each of said open end portions of said casing has an end face, said casing including a lower base plate, and a curved upper cover plate connected to the lower base plate, each of said hole units including an upper hole part formed in said upper cover plate, and a lower hole part formed in said lower base plate, said lower hole part being disposed closer to said end face of the respective one of said open end portions than said upper hole part.

3. The shoe of claim 1, wherein said decorative knot further has a retaining portion secured to said casing, said knot portion being connected to said retaining portion and being disposed externally of said casing, said medial portions of said first to fourth lace sections further extending between said casing and said knot portion.

4. A shoe comprising:

a shoe body having a pair of eyelet tabs; and a shoe lace device including first, second, third and fourth lace sections, each of which has a lower end and an upper end, said lower ends of said first to fourth lace sections being anchored on said shoe body, said upper ends of said first and second lace sections being interconnected to form a first loop, said upper ends of said third and fourth lace sections being interconnected to form a second loop, a clamp member sleeved slidably on medial portions of said first to fourth lace sections, downward movement of said clamp member along said first to fourth lace sections bringing said lower ends of said first to fourth lace sections closer together for tightening said shoe body, upward movement of said clamp member along said first to fourth lace sections permitting said lower ends of said first to fourth lace sections to move away from each for loosening said shoe body, and a decorative knot secured on and disposed externally of said clamp member, said decorative knot being disposed between said first and second loops, and having a knot portion and a pair of distal portions extending from said knot portion, wherein one of said first and second loops extends through the other of said first and second loops.

5. A shoe comprising:

a shoe body having a pair of eyelet tabs; and a shoe lace device including first, second, third and fourth lace sections, each of which has a lower end and an upper end, said lower ends of said first to fourth lace sections being anchored on said shoe body, said upper ends of said first and second lace sections being interconnected to form a first loop, said upper ends of said third and fourth lace sections being interconnected to form a second loop, a clamp member sleeved slidably on medial portions of said first to fourth lace sections, downward movement of said clamp member along said first to fourth lace sections bringing said lower ends of said first to fourth lace sections closer together for tightening said shoe body, upward movement of said clamp member along said first to fourth lace sections permitting said lower ends of said first to fourth lace sections to move away from each for loosening said shoe body, a decorative knot secured on and disposed externally of said clamp member, said decorative knot being disposed between said first and second loops, and having a knot portion and a pair of distal portions extending from said knot portion, a first hook member secured to said lower end of one of said first and second lace sections, and a second hook member secured to said lower end of one of said third and fourth lace sections, said first and second hook members hooking removably onto said eyelet tabs of said shoe body, respectively.

* * * * *